United States Patent [19]

Aono et al.

[11] 4,203,394

[45] May 20, 1980

[54] CLOSED-LOOP EMISSION CONTROL APPARATUS FOR INTERNAL COMBUSTION ENGINE WITH A CIRCUIT FOR GENERATING OFFSET VOLTAGE THAT CANCELS ERROR INTRODUCED DURING USE

[75] Inventors: Shigeo Aono, Seki; Akio Hosaka, Yokohama, both of Japan

[73] Assignee: Nissan Motor Company Limited, Yokohama, Japan

[21] Appl. No.: 769,871

[22] Filed: Feb. 11, 1977

[30] Foreign Application Priority Data

Feb. 12, 1976 [JP] Japan ..... 51-13250

[51] Int. Cl.[2] ..... F02B 3/00

[52] U.S. Cl. ..... 123/32 EE

[58] Field of Search ..... 123/32 EE, 119 EC; 60/276, 285

[56] References Cited

U.S. PATENT DOCUMENTS

| | | | |
|---|---|---|---|
| 3,745,768 | 7/1973 | Zechnall et al. | 60/285 |
| 4,019,474 | 4/1977 | Nishiamiya et al. | 123/32 EE |
| 4,029,061 | 6/1977 | Asano | 60/285 |
| 4,046,118 | 9/1977 | Aono | 123/32 EE |
| 4,057,042 | 11/1977 | Aono | 123/32 EE |

*Primary Examiner*—Charles J. Myhre
*Assistant Examiner*—R. A. Nelli

[57] ABSTRACT

A closed-loop emission control apparatus for internal combustion engines includes an exhaust composition sensor disposed at the upstream side of a catalytic converter which converts the noxious exhaust components into harmless products at the highest efficiency when the air-fuel ratio is controlled at a value in the vicinity of stoichiometry in accordance with a control signal derived from the sensed concentration of the exhaust composition. The output from the exhaust composition sensor is utilized to generate an offset voltage by averaging the instantaneous values of the sensed concentration, the offset voltage being combined with the control signal to cancel an error introduced thereinto during use of the apparatus.

7 Claims, 4 Drawing Figures

CLOSED-LOOP EMISSION CONTROL APPARATUS FOR INTERNAL COMBUSTION ENGINE WITH A CIRCUIT FOR GENERATING OFFSET VOLTAGE THAT CANCELS ERROR INTRODUCED DURING USE

FIELD OF THE INVENTION

The present invention relates generally to closed-loop emission control apparatus for internal combustion engines, and in particular to such apparatus capable of compensating for an error introduced into the control signal during the use of the apparatus over a substantial period of time.

BACKGROUND OF THE INVENTION

In a closed-loop emission control apparatus for internal combustion engines, a signal representing the concentration of an exhaust composition is generated by detecting the particular composition and modulated in amplitude in accordance with a predetermined control characteristic to provide a control signal which is fed back to an air-fuel mixing and proportioning device, whereby the air-fuel ratio of the mixture is controlled at a preset value. A catalytic converter is provided to simultaneously convert the noxious components present in the emissions into harmless products when the ratio is controlled at the preset value. However, the mixture ratio is also under the influence of various factors which include the operating characteristics of the closed control loop that vary from one vehicle to another and with time over the period of use of the apparatus, and external conditions that affect the performance of the engine. These factors combined will cause the control point of the system to drift from the optimum point where the catalytic converter provides maximum conversion efficiency.

To determine whether the air-fuel ratio is actually controlled at the optimum point for the catalytic converter, it has been proposed to provide an additional sensor at the downstream side of the catalytic converter to generate a compensating signal. However, the use of additional sensor will add to the complexity and cost of the apparatus.

SUMMARY OF THE INVENTION

It was found that the various factors that influence the air-fuel mixture over a substantial period of use will introduce into the control signal an error whose magnitude corresponds to the mean value of the content of residual oxygen.

An object of the present invention is therefore to remove the error at low frequency that drives the control point away from the setting point by generating an offset voltage which represents the mean value of the concentration of the exhaust composition sensed by the exhaust composition sensor disposed at the upstream side of the catalytic converter, and combining the offset voltage with the control signal to cancel the low-frequency error component contained therein.

Another object of the invention is to provide a closed-loop emission control apparatus for internal combustion engine which assures reduction of the noxious emission components to a minimum over an extended period of time.

BRIEF DESCRIPTION OF THE DRAWINGS

The invention will be further described by way of example with reference to the accompanying drawings; in which.

DESCRIPTION OF THE PREFERRED EMBODIMENTS

Figure 1:
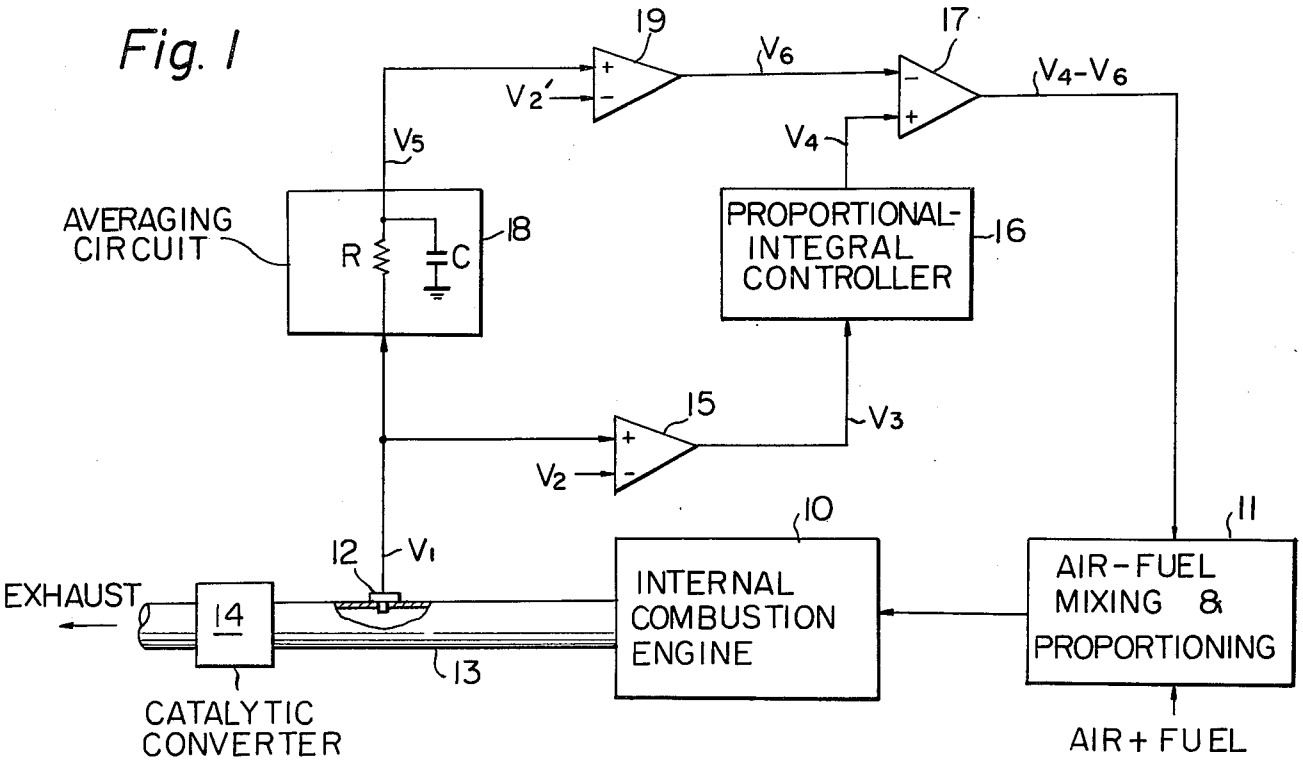
FIG. 1 is an embodiment of the present invention.

In FIG. 1, an internal combustion engine 10 receives air-fuel mixture from an air-fuel mixing and proportioning device 11 which meters the supply of mixture in proportion to an input signal applied thereto. An exhaust composition sensor 12 is disposed in the exhaust pipe 13 to detect the concentration of an exhaust composition such as residual oxygen contained in the emissions from the engine and provides an output signal V1 of which the amplitude is proportional to the detected concentration. A catalytic converter 14 is provided at the downstream side of the composition sensor 12 to convert the noxious components of the emissions into harmless products, the conversion efficiency being at the highest when the air-fuel ratio is controlled at a value in the vicinity of the stoichiometric value. The voltage V1 is supplied to an input of a differential amplifier 15 for comparison with a reference voltage V2 which represents the desired air-fuel in the vicinity of stoichiometry to which the mixture is to be controlled. The output V3 from the differential amplifier 15 thus represents the deviation of the sensed mixture ratio from the desired value.

A proportional-integral controller 16 receives the output V3 from the differential amplifier 15 to modulate its amplitude in accordance with predetermined proportional and integral control characteristics and provides an output V4 to the noninverting input of a differential amplifier 17.

The air-fuel mixing and proportioning device 11 receives the output from the differential amplifier 17 in order to correct the mixture ratio in accordance therewith. However, due to the inherent delay time which exists in the engine 10 from the instant of correction to the instant of detection at the sensor 12, there is a tendency in the system loop to keep influencing the air-fuel ratio after the desired setting value has been reached, and as a result control oscillation occurs in the control loop. Actually, this control oscillation is normally present even though the engine is operated under steady state or constant speed drive.

Between the exhaust composition sensor 12 and the inverting input of the differential amplifier 17 is provided an offset signal generating circuit which provides an offset voltage to cancel an error present in the output from the controller 16. The offset signal generating circuit comprises an averaging circuit 18 and a differential amplifier 19. The averaging circuit 18, which may comprise an RC filter or other equivalents thereof, receives the output from the exhaust composition sensor 12 to provide an output V5 which represents the average or mean value of the instantaneous values of the sensed oxygen concentration which fluctuates due to the control oscillation as described above. The output V5 is supplied to the noninverting input of a differential amplifier 19 for comparison with a reference voltage V2', which may be equal to V2, to deliver an output V6 to the inverting input of the differential amplifier 17 to provide an output representing the difference between the two input voltages V4 and V6.

The error contained in the output from the controller 16 results from maladjustments of some components of the control loop which may occur as a result of use over a substantial period of time and from varying extraneous conditions to which the engine is subject. Such an error will shift the actual control point from that which is optimal for the catalytic converter to operate at its maximum efficiency for simultaneous conversion of the noxious components CO, HC and NOx.

Figure 4:
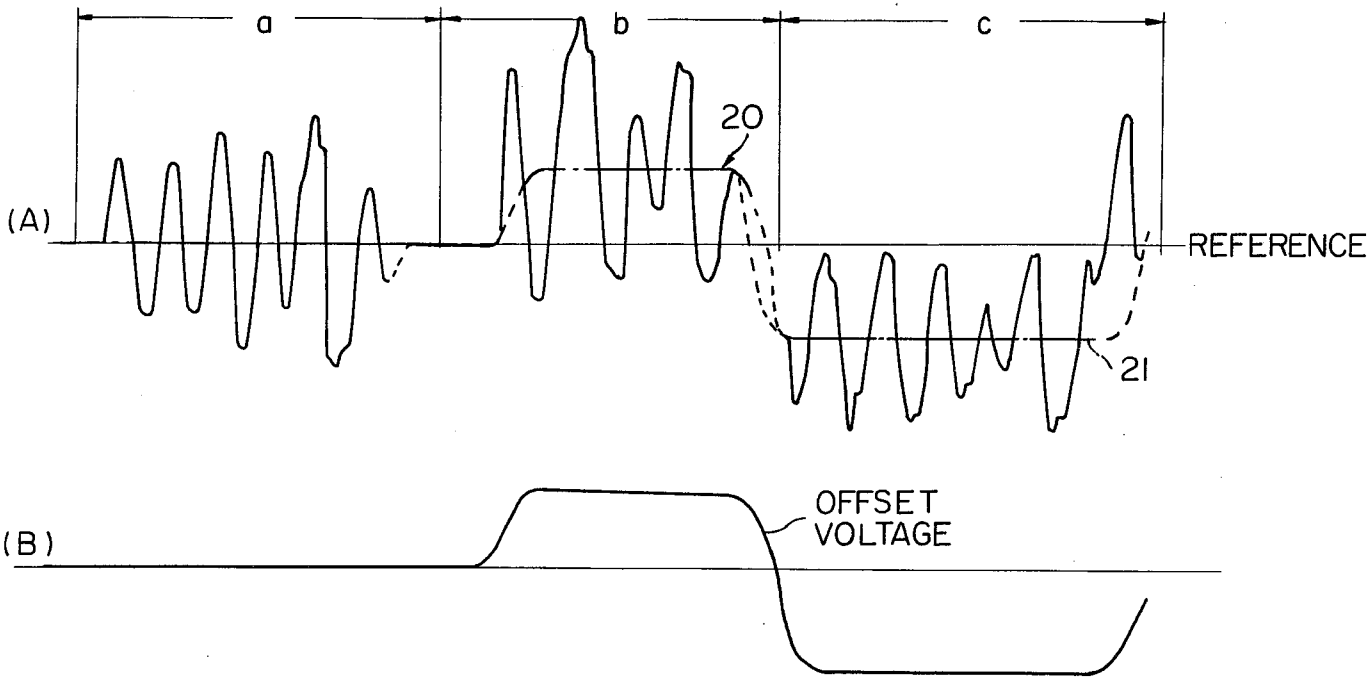
FIG. 4 is a waveform diagram useful for describing the invention.

As shown in FIG. 4A, when the system is adjusted correctly at a control level optimum for the catalytic converter, the average value of the sensed concentration corresponds to the reference or desired control level as indicated by the waveform during period "a". On the other hand, during period "b" the output from the exhaust composition sensor 12 varies such that the averaging circuit 18 provides a positive polarity voltage signal, and during period "c" the situation is reversed and the averaging circuit provides a negative polarity voltage signal. Both positive and negative signals are compared with the reference voltage V2' in the differential amplifier 19 to generate offset voltage shown in FIG. 4B. If the output from the controller 16 is directly applied to the mixture proportioning device 11, the control level would be shifted to the levels 20 and 21 during the periods "b" and "c", respectively. The differential amplifier 17 cancels the error to restore the control level to the reference level in proportion to the signal from the differential amplifier 19.

Figure 2:
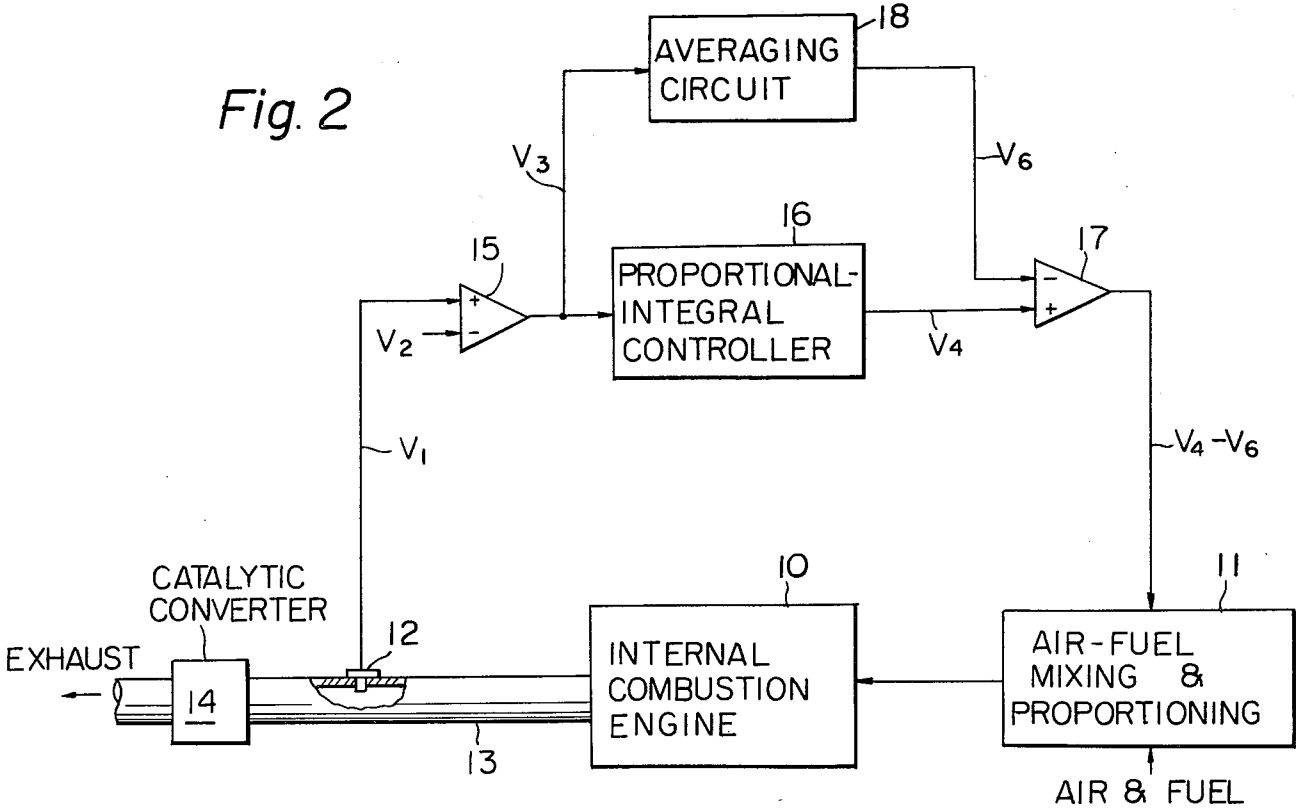
FIG. 2 is an elternative embodiment of FIG. 1.

An alternative embodiment of FIG. 1 is illustrated in FIG. 2 in which, instead of connecting the input of the averaging circuit 18 to the output of exhaust composition sensor 12, this input is connected to the output of differential amplifier 15 and the output of the averaging circuit is connected directly to the inverting input of differential amplifier 17, thereby eliminating the use of the differential amplifier 19 of FIG. 1. In this embodiment, the output from the differential amplifier 15 is averaged by the circuit 18 and applied to the differential amplifier 17 to offset the voltage output V4 from the controller 16.

Figure 3:
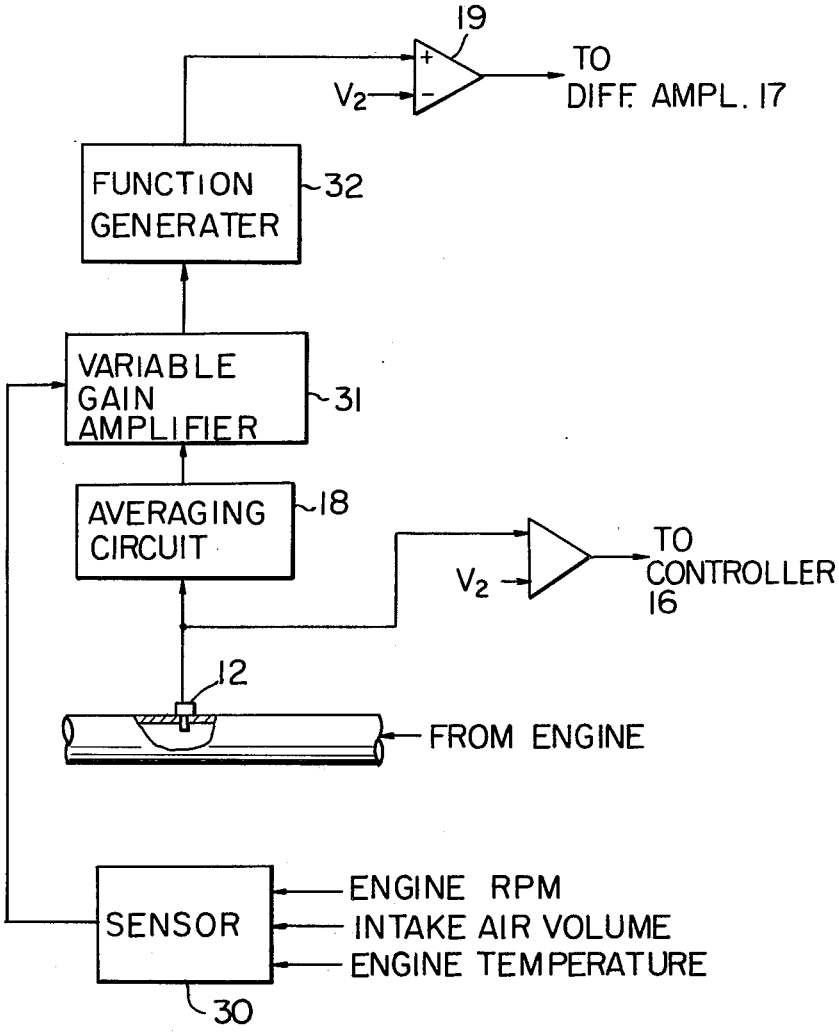
FIG. 3 is a modification of the embodiment of FIG. 1.

A modification of FIG. 1 is illustrated in FIG. 3 in which a sensor 30 is provided for detecting one or more of engine operating parameters such as engine rpm, intake air volume and engine temperature to provide an output representative of the sensed parameter to a variable gain amplifier 31 connected to the output of the averaging circuit 18. The gain of the amplifier 31 is controlled in accordance with the sensed engine parameter to modulate the amplitude of the mean value of the sensed oxygen concentration and provides the amplitude modulated average signal to a function generator 32. The function generator 32 has a predetermined nonlinear characteristic that is complementary to the output characteristic of the exhaust composition sensor 12 to provide a compensated output to the differential amplifier 19.

If an additional exhaust composition sensor is provided at the downstream side of the catalytic converter 14, this sensor would provide an output having the average value of the instantaneous values of the concentration sensed by the sensor 12 at the upstream side of the converter 14. It is noted therefore that the time constant value of the averaging circuit 18 be selected such that its output characteristic is analogous to that obtained by the downstream side exhaust composition sensor in order to simulate the averaging performance of the catalytic converter, and that the selected time constant value be greater than the time constant or integration rate of the proportional-integral controller 16.

What is claimed is:

1. A closed loop mixture control system for an internal combustion engine having an exhaust gas sensor for generating a signal representative of the concentration of a predetermined constitutent of the exhaust gases from said engine, said gas sensor having a tendency to vary its operation characteristic as a function of aging, a catalytic converter disposed downstream of said exhaust gas sensor for converting the exhaust gases into harmless waste products when the concentration of said constituent gas is maintained within a predetermined range, and means for supplying mixture at a desired air-fuel ration in response to a feedback control signal, comprising:

a first feedback circuit having an input terminal connected to said exhaust gas sensor, an averaging circuit and a first differential amplifier connected in series thereto for generating a first signal representative of the deviation of a mean value of said concentration representative signal from a reference level representing said desired air-fuel ratio;

a second feedback circuit having an input terminal connected to a portion of said first feedback circuit and a control circuit to derive a second signal representative of the deviation of said concentration representative signal from a reference level representing said desired air-fuel ratio, said second signal being modified in amplitude in accordance with a predetermined control characteristic;

a second differential amplifier having two input terminals connected respectively to the output terminals of said first and second feedback circuits for generating a third signal representative of the difference between said first and second signals, the output terminal of said second differential amplifier being connected to said mixture supplying means to apply said second third signal thereto as said feedback control signal.

2. A closed loop mixture control system as claimed in claim 1, wherein said averaging circuit is connected to the exhaust gas sensor and said first differential amplifier has a first input terminal connected to be responsive to the output signal from said averaging circuit and a second input terminal connected to be responsive to a reference potential representing said desired air-fuel ratio, the output signal from said first differential amplifier being said first signal.

3. A closed loop mixture control system as claimed in claim 1, wherein said second differential amplifier has a first input terminal connected to said exhaust gas sensor and a second input terminal connected to be responsive to a reference potential representing said desired air-fuel ratio, and said averaging circuit is connected to the output of said first differential amplifier, the output of said averaging circuit being said first signal.

4. A closed loop mixture control system as claimed in claim 1, wherein said control circuit includes a proportional integral controller.

5. A closed loop mixture control system as claimed in claim 1, further comprising means for sensing an operating parameter of said engine, means connected to the output of said averaging circuit for modifying the amplitude of an output signal from said averaging circuit in response to the sensed engine operating parameter, and a function generator having an input-output characteristic which is complementary to the operating characteristic of the exhaust gas sensor, the output of said function generator being connected to said first differential amplifier.

6. A closed loop mixture control system as claimed in claim 2, wherein said second feedback circuit includes a third differential amplifier having a first input terminal connected to be responsive to a reference potential representing said desired air-fuel ratio, said proportional integral controller being connected to the output terminal of said third differential amplifier to generate a signal corresponding to said second signal.

7. A closed loop mixture control system as claimed in claim 5, wherein said amplitude modifying means comprises a variable gain-controlled amplifier.

* * * * *